US011560006B2

(12) United States Patent
Ishida et al.

(10) Patent No.: US 11,560,006 B2
(45) Date of Patent: Jan. 24, 2023

(54) THERMAL TRANSFER SHEET

(71) Applicant: Dai Nippon Printing Co., Ltd., Tokyo (JP)

(72) Inventors: Tadahiro Ishida, Tokyo (JP); Megumi Ikeda, Tokyo (JP); Yusuke Narumi, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 335 days.

(21) Appl. No.: 16/640,893

(22) PCT Filed: Dec. 21, 2018

(86) PCT No.: PCT/JP2018/047309

§ 371 (c)(1),
(2) Date: Feb. 21, 2020

(87) PCT Pub. No.: WO2020/026467

PCT Pub. Date: Feb. 6, 2020

(65) Prior Publication Data

US 2021/0070084 A1 Mar. 11, 2021

(30) Foreign Application Priority Data

Jul. 30, 2018 (JP) ..... JP2018-142712

(51) Int. Cl.
*B41M 5/382* (2006.01)
*B41M 5/44* (2006.01)
*B41M 5/395* (2006.01)

(52) U.S. Cl.
CPC ..... *B41M 5/38214* (2013.01); *B41M 5/395* (2013.01); *B41M 5/44* (2013.01);
(Continued)

(58) Field of Classification Search
CPC .... B41M 5/38214; B41M 5/395; B41M 5/42; B41M 5/44; B41M 2205/06; B41M 2205/30; B41M 2205/38
See application file for complete search history.

(56) References Cited

U.S. PATENT DOCUMENTS 4,970,119 A * 11/1990 Koshizuka ..... B41M 5/38207 428/913
10,336,115 B2 * 7/2019 Yoda ..... B41M 5/42
(Continued)

FOREIGN PATENT DOCUMENTS

CN 107020855 A 8/2017
EP 3 196041 A1 7/2017
(Continued)

OTHER PUBLICATIONS

Chinese Office Action (Application No. 201880070680.0) dated Jan. 26, 2021 (with English translation).
(Continued)

*Primary Examiner* — Gerard Higgins
(74) *Attorney, Agent, or Firm* — Burr & Brown, PLLC

(57) ABSTRACT

A thermal transfer sheet is provided, which allows for forming an image favorable to any transfer objects having a poor smoothness or a high smoothness. The thermal transfer sheet according to the present invention includes a substrate, and a transfer layer. The transfer layer includes a release layer, a colorant layer and an adhesive layer. The release layer includes a polyethylene glycol having a number average molecular weight Mn in a range of 8000 or more to 23000 or less, and the colorant layer includes a colorant and a vinyl chloride-vinyl acetate copolymer.

8 Claims, 2 Drawing Sheets

(52) U.S. Cl.
CPC ..... *B41M 2205/06* (2013.01); *B41M 2205/30* (2013.01); *B41M 2205/38* (2013.01)

(56) References Cited

U.S. PATENT DOCUMENTS

| | | | |
|---|---|---|---|
| 2005/0145325 | A1 | 7/2005 | Kronzer |
| 2017/0190202 | A1 | 7/2017 | Imakura |
| 2017/0190203 | A1 | 7/2017 | Imakura |
| 2017/0259601 | A1 | 9/2017 | Hayashi et al. |

FOREIGN PATENT DOCUMENTS

| | | | |
|---|---|---|---|
| JP | S61-235189 | A1 | 10/1986 |
| JP | H02-151489 | A1 | 6/1990 |
| JP | H07-266727 | A1 | 10/1995 |
| JP | 2005-001291 | A1 | 1/2005 |
| JP | 2016-064651 | A1 | 4/2016 |
| JP | 2017-121734 | A1 | 7/2017 |
| JP | 2017-121735 | A1 | 7/2017 |
| JP | 2017-165073 | A1 | 9/2017 |
| KR | 10-2007-0026349 | A | 3/2007 |

OTHER PUBLICATIONS

English translation of the International Preliminary Report on Patentability (Chapter I) (Application No. PCT/JP2018/047309) dated Feb. 11, 2021.
International Search Report and Written Opinion (Application No. PCT/JP2018/047309) dated Feb. 5, 2019.
Extended European Search Report (Application No. 18928922.6) dated Apr. 12, 2021.
Korean Office Action (Application No. 10-2020-7012243) dated Oct. 19, 2021 (with English translation).

* cited by examiner

THERMAL TRANSFER SHEET

BACKGROUND OF THE INVENTION

Field of the Invention

The present invention relates to a thermal transfer sheet.

Background Art

Conventionally, a thermofusible transfer process in which a thermal transfer sheet, including a substrate and a transfer layer including a colorant layer containing a colorant, is subjected to applying energy using a thermal head or the like to transfer a transfer layer onto a transfer object such as papers and plastic sheets to form an image to produce a printed matter, is known.

Because the image formed by the thermofusible transfer process is of high density and excellent to sharpness, the process is suitable for recording a binary image such as characters and line drawings. In addition, by the thermofusible transfer process, variable information such as addresses, customer information, numberings and bar codes can be recorded on a transfer object using a computer and a thermal transfer printer.

There is a drawback in which, when an image is formed by the above-mentioned process on a transfer object having a poor smoothness, voids may occur between a concave area of the surface of the transfer object and the transfer layer, thereby significantly impairing the quality of the printed matter.

In Patent Document 1, in order to solve the above-mentioned drawback, a medium layer including polyethylene glycol between a substrate and a colorant layer which are included in a thermal transfer sheet is proposed to be provided.

PRIOR ART REFERENCE

Patent Document

Patent Document 1: JP S61-235189 A

SUMMARY OF THE INVENTION

Problems to be Solved by the Invention

Now, the present inventors obtained a finding that, when an image is formed on a transfer object having a high smoothness using a thermal transfer sheet disclosed in Patent Document 1 and the image in which a bar code is present perpendicularly to the direction of printing such as a Ladder bar code image (see FIG. 3) is formed, collapses of the transfer layer occur, thereby impairing the quality of the obtained printed matter.

The present invention has been made in view of the above problems, and an object to be solved is to provide a thermal transfer sheet which allows for forming an image favorable to any of transfer objects having a poor smoothness and a high smoothness (hereinafter, may be referred to as image-forming ability).

Means for Solving the Problems

A thermal transfer sheet according to the present invention comprising:

a substrate; and a transfer layer comprising a release layer, a colorant layer and an adhesive layer, wherein the release layer comprises a polyethylene glycol having a number average molecular weight of 8000 or more and 23000 or less, and the colorant layer comprises one or both of a polyester and a vinyl chloride-vinyl acetate copolymer, and a colorant.

In an embodiment, the colorant layer comprises a first polyester having Mn of 15000 or more and a second polyester having Mn of 5000 or less.

In an embodiment, the colorant layer comprises the vinyl chloride-vinyl acetate copolymer having Mn of 20000 or less.

In an embodiment, a content of the resin materials in the colorant layer is 55% by mass or more and 85% by mass or less.

In an embodiment, a content of a first polyester in the colorant layer is 20% by mass or more and 40% by mass or less.

In an embodiment, a content of a second polyester in the colorant layer is 20% by mass or more and 45% by mass or less.

In an embodiment, a ratio of the content of the first polyester to the content of the second polyester in the colorant layer (the content of the first polyester/the content of the second polyester) is 45/55 or more and 80/20 by mass or less.

In an embodiment, a melting point of the polyethylene glycol is 55° C. or more and 65° C. or less.

In an embodiment, the adhesive layer comprises one or both of a polyester and a chlorinated resin of polyolefin.

Effect of the Invention

According to the present invention, a thermal transfer sheet which allows for forming an image favorable to any of transfer objects having a poor smoothness and a high smoothness can be provided.

DETAILED DESCRIPTION OF THE INVENTION (Thermal Transfer Sheet)

Figure 1:
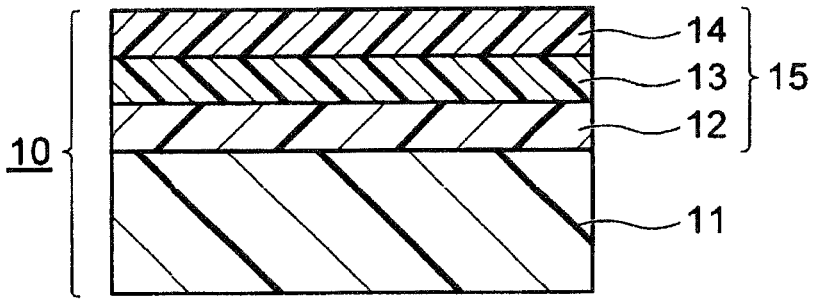
FIG. 1 is a schematic sectional view showing an embodiment of a thermal transfer sheet according to the present invention.

A thermal transfer sheet 10 according to the present invention comprises a substrate 11 and a transfer layer 15 comprising a release layer 12, a colorant layer 13 and an adhesive layer 14, as shown in FIG. 1.

Figure 2:
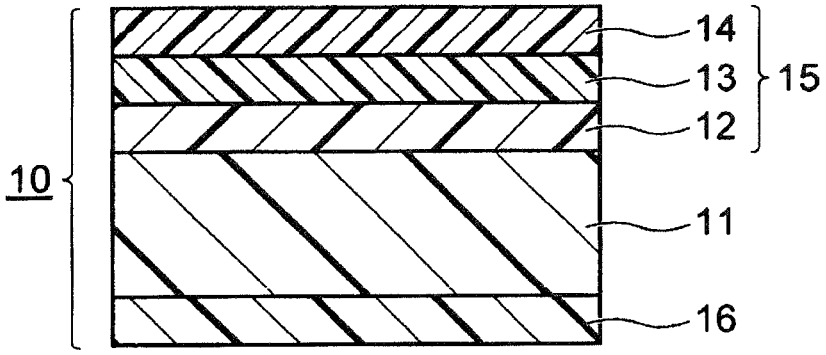
FIG. 2 is a schematic sectional view showing an embodiment of a thermal transfer sheet according to the present invention.

In an embodiment, the thermal transfer sheet 10 comprises a back layer 16 on the opposite side from the surface provided with the transfer layer 15 of the substrate 11, as shown in FIG. 2.

Moreover, in an embodiment, the thermal transfer sheet 10 according to the present invention may further comprise a mold release layer and/or a primer layer on the substrate (not shown).

Each layer constituting the thermal transfer sheet according to the present invention will be described below.

(Substrate)

The substrate can be employed, in particular, unlimitedly as long as it has heat resistance such that it is resistant under heat energy to be applied during heat transfer and mechanical strength and solvent resistance such that it can support a transfer layer and/or the like provided on the substrate.

As a substrate, for example, polyesters such as polyethylene terephthalate (PET), polybutylene terephthalate (PBT), polyethylene naphthalate (PEN), 1,4-polycyclohexylenedimethylene terephthalate and terephthalic acid-cyclohexanedimethanol-ethylene glycol copolymer, polyamides such as nylon 6 and nylon 6,6, polyolefins such as polyethylene (PE), polypropylene (PP) and polymethylpentene, vinyl resins such as polyvinyl chloride, polyvinyl alcohol (PVA), polyvinyl acetate, vinyl chloride-vinyl acetate copolymer, polyvinyl butyral and polyvinylpyrrolidone (PVP), (meth)acrylate resins such as polyacrylates, polymethacrylates and polymethyl methacrylate, imide resins such as polyimides and polyether-imides, cellulose resins such as cellophane, cellulose acetate, nitrocellulose, cellulose acetate propionate (CAP) and cellulose acetate butyrate (CAB), polystyrene resins such as polystyrene (PS), polycarbonates, and films consisting of ionomer resin(s) and/or the like (hereinafter referred to as "resin film") can be employed.

Among the above-mentioned resins, from the viewpoint of heat resistance and mechanical strength, polyesters such as PET and PEN are preferable, and PET is in particular preferable.

Noted that, in the present invention, the term "(meth) acrylic" encompasses both "acrylic" and "methacrylic". Similarly, the term "(meth)acrylate" encompasses both "acrylate" and "methacrylate".

A laminate of the above-mentioned resin films can be also employed as a substrate. The laminate of the resin films can be produced by means of using dry lamination, wet lamination, extrusion and the like.

When the substrate is a resin film, the resin film may be a stretched film or an unstretched film, and a stretched film that is stretched uniaxially or biaxially is preferably employed from the viewpoint of strength.

A thickness of the substrate is preferably 2 μm or more and 25 μm or less, and more preferably 3 μm or more and 10 μm or less. This allows for an excellent heat energy transfer during heat transfer and excellent mechanical strength of the substrate.

(Transfer Layer)

The thermal transfer sheet according to the present invention comprises a transfer layer, and the transfer layer comprises a release layer, a colorant layer and an adhesive layer.

(Release Layer)

The release layer comprises at least one polyethylene glycol (hereinafter referred to as polyethylene glycol) having a number average molecular weight (Mn) of 8000 or more and 23000 or less, thereby improving an image-forming ability on a transfer object having a poor smoothness and an image-forming ability on a transfer object having a high smoothness of a thermal transfer sheet according to the present invention.

Furthermore, from the viewpoint of the image-forming ability, Mn of polyethylene glycol is preferably 9000 or more and 19000 or less, more preferably 10000 or more and 17000 or less, and particularly preferably 10000 or more and 13000 or less.

Note that, in the present invention, Mn is a value obtained based on polystyrene by gel permeation chromatography (GPC) in conformity to MS K 7252-1 (issued in 2008).

The melting point of polyethylene glycol is preferably 55° C. or more and 65° C. or less, and more preferably 60° C. or more and 65° C. or less. This allows for improving more the image-forming ability on a transfer object having a poor smoothness and the image-forming ability on a transfer object having a high smoothness.

Note that, in the present invention, a melting point can be measured by differential scanning calorimeter (DSC) in conformity to JIS K 7121.

The content of polyethylene glycol in the release layer is preferably 40% by mass or more and 100% by mass or less, and more preferably 45% by mass or more and 100% by mass or less. This allows for improving more the image-forming ability on a transfer object having a poor smoothness and the image-forming ability on a transfer object having a high smoothness.

The release layer may include a resin material other than polyethylene glycol having Mn of 8000 or more and 23000 or less in a range that does not impair the characteristics of the present invention, and the examples include polyol resins such as polyethylene glycol having Mn of less than 8000, polyethylene glycol and polypropylene glycol which have Mn of more than 23000, polyolefins, vinyl resins, (meth)acrylate resins, imide resins, cellulose resins, styrene resins, and ionomer resins.

The release layer may include a wax in a range that does not impair the characteristics of the present invention, and the examples include a microcrystalline wax, Carnauba wax, paraffin waxes, Fischer-Tropsch wax, japan wax, beeswax, whale wax, insect wax, wool wax, shellac wax, candelilla wax, petrolactam, partially denatured wax, fatty acid esters and fatty acid amides.

The resistance to rubbing of a printed matter produced using the thermal transfer sheet according to the present invention can be improved by including a wax in the release layer. Furthermore, the temporal stability of a coating liquid which is prepared by dispersing or dissolving the wax with the above-mentioned polyethylene glycol into water or a suitable solvent can be improved.

The content of the wax in the release layer is preferably 20% by mass or more and 60% by mass or less, and more preferably 30% by mass or more and 55% by mass or less. This allows for improving more the temporal stability of the above-mentioned coating liquid as well as the resistance to rubbing of the printed matter.

The release layer may include an additive such as a filler, plasticizer, antistatic material, ultraviolet absorber, inorganic particulate, organic particulate, mold release material and dispersant.

A thickness of the release layer is preferably 0.1 μm or more and 1 μm or less, and more preferably 0.2 μm or more and 0.6 μm or less. This allows for improving more the transferability of the transfer layer as well as the image-forming ability on a transfer object having a poor smoothness and the image-forming ability on a transfer object having a high smoothness.

The release layer can be formed in such a way that the above-mentioned materials are dispersed or dissolved in water or a suitable solvent, and the mixture is coated on the substrate or the like by known means such as roll coating, reverse roll coating, gravure coating, reverse gravure coating, bar coating and rod coating to form a coating film, and the film is then dried.

(Colorant Layer)

The colorant layer comprises one or both of a polyester and a vinyl chloride-vinyl acetate copolymer, and a colorant.

In an embodiment, the colorant layer comprises a first polyester having Mn of 15000 or more and a second polyester having Mn of 5000 or less. This allows for improving more the image-forming ability on a transfer object having a high smoothness of the thermal transfer sheet according to the present invention and also alcohol resistance of a printed matter produced by using this.

From the viewpoint of alcohol resistance, Mn of the first polyester is preferably 15000 or more and 40000 or less, and more preferably 15000 or more and 25000 or less.

From the viewpoint of alcohol resistance, Mn of the second polyester is preferably 2000 or more and 5000 or less, and more preferably 3000 to 5000.

The colorant layer may include two or more of the first polyesters and may include two or more of the second polyesters.

In the present invention, polyester means a copolymer of a dicarboxylic acid compound and a diol compound.

Examples of dicarboxylic acids include malonic acid, succinic acid, glutaric acid, adipic acid, suberic acid, sebacic acid, dodecanedioic acid, eicosanedioic acid, pimelic acid, azelaic acid, methylmalonic acid, ethylmalonic acid, adamantanedicarboxylic acid, norbornenedicarboxylic acid, cyclohexanedicarboxylic acid, decalindicarboxylic acid, terephthalic acid, isophthalic acid, phthalic acid, 1,4-naphthalenedicarboxylic acid, 1,5-naphthalenedicarboxylic acid, 2,6-naphthalenedicarboxylic acid, 1,8-naphthalenedicarboxylic acid, 4,4'-diphenyldicarboxylic acid, 4,4'-diphenyl ether dicarboxylic acid, sodium-5-sulfoisophthalic acid, phenylindandicarboxylic acid, anthracenedicarboxylic acid, phenanthrenedicarboxylic acid, 9,9'-bis(4-carboxyphenyl) fluorene acid, and ester derivatives thereof.

Examples of diol compounds include ethylene glycol, 1,2-propanediol, 1,3-propanediol, butanediol, 2-methyl-1,3-propanediol, hexanediol, neopentyl glycol, cyclohexanedimethanol, cyclohexanediethanol, decahydronaphthalenedimethanol, decahydronaphthalenediethanol, norbornanedimethanol, norbornanediethanol, tricyclodecanedimethanol, tricyclodecanediethanol, tetracyclododecanedimethanol, tetracyclododecanediethanol, decalindimethanol, decalindiethanol, 5-methylol-5-ethyl-2-(1,1-dimethyl-2-hydroxyethyl)-1,3-dioxane, cyclohexanediol, bicyclohexyl-4,4'-diol, 2,2-bis(4-hydroxycyclohexylpropane), 2,2-bis(4-(2-hydroxyethoxy)cyclohexyl)propane, cyclopentanediol, 3-methyl-1,2-cyclopentanediol, 4-cyclopentene-1,3-diol, adamantanediol, para-xylene glycol, bisphenol A, bisphenol S, styrene glycol, trimethylolpropane and pentaerythritol.

A compound other than dicarboxylic acid compounds and diol compounds may be included as a copolymer component in a range that does not impair the characteristics of the present invention. The proportion of a constitutional unit derived from the above-mentioned other compound in the polyester is preferably 10% by mass or less, more preferably 5% by mass or less, and still more preferably 3% by mass or less.

The content of the first polyester in the colorant layer is preferably 20% by mass or more and 40% by mass or less, more preferably 25% by mass or more and 34% by mass or less, and still more preferably 27% by mass or more and 31% by mass or less. This allows for improving more the image-forming ability on a transfer object having a high smoothness of the thermal transfer sheet according to the present invention and also alcohol resistance of a printed matter produced by using the thermal transfer sheet.

The content of the second polyester in the colorant layer is preferably 20% by mass or more and 45% by mass or less, more preferably 25% by mass or more and 39% by mass or less, and still more preferably 28% by mass or more and 32% by mass or less. This allows for improving more the image-forming ability on a transfer object having a high smoothness of the thermal transfer sheet according to the present invention and also alcohol resistance of a printed matter produced by using the thermal transfer sheet.

The ratio of the content of the first polyester to the content of the second polyester in the colorant layer (the content of the first polyester/the content of the second polyester) is 45/55 or more and 80/20 by mass or less, and more preferably 45/55 or more and 55/45 by mass or less. This allows for improving more the image-forming ability on a transfer object having a high smoothness of the thermal transfer sheet according to the present invention and also alcohol resistance of a printed matter produced by using the thermal transfer sheet.

In an embodiment, the colorant layer comprises the vinyl chloride-vinyl acetate copolymer having Mn of 20000 or less. This allows for improving more the image-forming ability on a transfer object having a high smoothness of the thermal transfer sheet according to the present invention and also alcohol resistance of a printed matter produced by using this.

From the viewpoint of the alcohol resistance, Mn of vinyl chloride-vinyl acetate copolymer is preferably 8000 or more and 18000 or less, more preferably 10000 or more and 15000 or less, and particularly preferably 11000 or more and 13000 or less.

In the present invention, vinyl chloride-vinyl acetate copolymer means a copolymer of vinyl chloride and vinyl acetate.

The vinyl chloride-vinyl acetate copolymer may contain as a copolymer component a compound other than vinyl chloride and vinyl acetate in a range that does not impair the characteristics of the present invention. The proportion of a constitutional unit derived from the above-mentioned other compound in the vinyl chloride-vinyl acetate copolymer is preferably 10% by mass or less, more preferably 5% by mass or less, and still more preferably 3% by mass or less.

The content of vinyl chloride-vinyl acetate copolymer in the colorant layer is preferably 40% by mass or more and 85% by mass or less, more preferably 50% by mass or more and 80% by mass or less, and still more preferably 55% by mass or more and 75% by mass or less. This allows for improving more the image-forming ability on a transfer object having a high smoothness of the thermal transfer sheet according to the present invention and also alcohol resistance of a printed matter produced by using the thermal transfer sheet.

The colorant layer may include a resin material other than a polyester and vinyl chloride-vinyl acetate copolymer in a range that does not impair the characteristics of the present invention, and the content of the resin material is preferably 5% by mass or less, and more preferably 2.5% by mass or less.

Examples of the resin materials include polyamides, polyolefins, vinyl resins, (meth)acryl resins, cellulose resins, styrene resins, polycarbonates and ionomer resins.

The content of the resin material in the colorant layer is preferably 55% by mass or more and 85% by mass or less, more preferably 55% by mass or more and 80% by mass or less, and still more preferably 55% by mass or more and 65% by mass or less. This allows for improving more alcohol resistance of a printed matter produced by using the thermal transfer sheet according to the present invention and also the image density of the printed matter.

A carbon black, an inorganic pigment, an organic pigment or a dye can be appropriately selected for use as a colorant included in the colorant layer according to requirement such as the color adjustment and the like. For example, it is preferable that a bar code printing have especially sufficient black density and do not discolor or fade in color due to light, heat and the like. Examples of such colorants include carbon blacks such as a lamp black, graphites and nigrosin dyes. When a color printing is required, another chromatic color dye or pigment is employed.

The content of the colorant in the colorant layer is preferably 25% by mass or more and 45% by mass or less, more preferably 30% by mass or more and 45% by mass or less, and particularly preferably 35% by mass or more and 45% by mass or less. This allows for improving the image-forming ability on a transfer object having a poor smoothness and the image-forming ability on a transfer object having a high smoothness of the thermal transfer sheet according to the present invention and also the image density formed maintaining alcohol resistance of a printed matter produced by using the thermal transfer sheet.

The colorant layer may include the above-mentioned additive in a range that does not impair the characteristics of the present invention.

The thickness of the colorant layer is preferably 0.3 μm or more and 1.2 μm or less, and more preferably 0.4 μm or more and 1 μm or less. This allows for improving the image-forming ability on a transfer object having a poor smoothness and the image-forming ability on a transfer object having a high smoothness of the thermal transfer sheet according to the present invention, and also transferability of the transfer layer and the image density formed maintaining alcohol resistance of a printed matter produced by using the thermal transfer sheet.

The colorant layer can be formed in such a way that the above-mentioned materials are dispersed or dissolved in water or a suitable solvent, and the mixture is coated on the release layer or the like by known means such as roll coating, reverse roll coating, gravure coating, reverse gravure coating, bar coating and rod coating to form a coating film, and the film is then dried.

(Adhesive Layer)

In an embodiment, the adhesive layer is softened by heating and includes at least one thermoplastic resin which exhibits adhesion properties.

Examples of the thermoplastic resins include polyesters, vinyl resins, (meth)acryl resins, polyurethanes, cellulose resins, polyamides, polyolefins, styrene resins and chlorinated resins thereof.

Among these, from the viewpoint of alcohol resistance and adhesion properties to a transfer object, a polyester and a chlorinated resin of the above-mentioned resin material are preferred, a polyester and chlorinated polyolefin are more preferred, and a combination of a polyester and a chlorinated polyolefin is particularly preferred.

Mn of the thermoplastic resin included in the adhesive layer is preferably 2000 or more and 25000 or less, and more preferably 3000 or more and 20000 or less. This allows for improving more alcohol resistance and adhesion properties to a transfer object.

The glass transition temperature (Tg) of the thermoplastic resin is 20° C. or more and 90° C. or less, and more preferably 50° C. or more and 80° C. or less. This allows for improving more alcohol resistance, adhesion properties to a transfer object and blocking resistance.

Note that, in the present invention, Tg is a value obtained by DSC (differential scanning calorimeter) in conformity to JIS K 7121.

The content of the thermoplastic resin in the adhesive layer is preferably 50% by mass or more and 90% by mass or less, and more preferably 60% by mass or more and 85% by mass or less. This allows for improving more alcohol resistance and adhesion properties to a transfer object.

The adhesive layer can include the above-mentioned additive in a range that does not impair the characteristics of the present invention.

The thickness of adhesive layer is preferably 0.05 μm or more and 0.5 μm or less, and more preferably 0.1 μm or more and 0.3 μm or less. This allows for improving more alcohol resistance and adhesion properties to a transfer object.

The adhesive layer can be formed in such a way that the above-mentioned materials are dispersed or dissolved in water or a suitable solvent, and the mixture is coated on the colorant layer or the like by known means such as roll coating, reverse roll coating, gravure coating, reverse gravure coating, bar coating and rod coating to form a coating film, and the film is then dried.

(Back Layer)

In an embodiment, the thermal transfer sheet according to the present invention includes a back layer on the side which is not provided with the transfer layer of the substrate. This allows for preventing occurrence of sticking and/or wrinkling due to heating during thermal transfer.

In an embodiment, the back layer includes a resin material, and examples of the resin materials include cellulose resins, styrene resins, vinyl resins, polyesters, polyurethanes, silicone-modified polyurethanes, fluorine-modified polyurethanes and (meth)acryl resins.

Furthermore, in an embodiment, the back layer include as a resin material a two-part curable resin which is hardened in combination with an isocyanate compound and/or the like. Examples of such resins include polyvinyl acetals such as polyvinyl acetoacetal and polyvinyl butyral.

In an embodiment, the back layer includes an inorganic or organic particle. This allows for preventing occurrence of sticking and/or wrinkling due to heating during thermal transfer.

Examples of the inorganic particles include clay minerals such as talcs and kaolins, carbonate salts such as calcium carbonate and magnesium carbonate, hydroxides such as aluminum hydroxide and magnesium hydroxide, sulfates such as calcium sulfate, oxides such as silica, graphite, niter, and inorganic particles such as boron nitride.

Examples of the organic particles include organic particles composed of (meth)acryl resins, teflon (registered trade name) resins, silicone resins, lauroyl resins, phenol resins, acetal resins, styrene resins, polyamides and the like, or crosslinked resin particles produced by reaction of these with a crosslinking agent.

The thickness of the back layer is preferably 0.1 μm or more and 2 μm or less, and more preferably 0.1 μm or more and 1 μm or less. This allows for preventing occurrence of sticking and/or wrinkling maintaining ability of heat energy transfer during thermal transfer.

The back layer can be formed in such a way that the above-mentioned materials are dispersed or dissolved in water or a suitable solvent, and the mixture is coated on the substrate by known means such as roll coating, reverse roll coating, gravure coating, reverse gravure coating, bar coating and rod coating to form a coating film, and the film is then dried.

(Mold Release Layer)

In an embodiment, the thermal transfer sheet according to the present invention includes a mold release layer disposed between a substrate and a transfer layer. This allows for improving transferability of the thermal transfer sheet.

In an embodiment, the mold release layer includes a resin material, and examples of the resin material include (meth) acryl resins, polyurethanes, polyamides, polyesters, melamine resins, polyol resins, cellulose resins and silicone resins.

Furthermore, in an embodiment, the mold release layer include a mold releasing agent such as a silicone oil, phosphate ester-based plasticizer, fluorine-containing compound, wax, metal soap, and filler.

The thickness of the mold release layer can be, but not limited to, for example, 0.2 μm or more and to 2 μm or less.

The mold release layer can be formed in such a way that the above-mentioned materials are dispersed or dissolved in water or a suitable solvent, and the mixture is coated on the substrate by known means such as roll coating, reverse roll coating, gravure coating, reverse gravure coating, bar coating and rod coating to form a coating film, and the film is then dried.

(Primer Layer)

In an embodiment, the thermal transfer sheet according to the present invention includes a primer layer(s) on one side or both sides of the substrate. This allows for improving adhesion properties between the substrate and the adjacent layer.

In an embodiment, the primer layer includes a polyester, vinyl resin, polyurethane, (meth)acryl resin, polyamide, ether resin, cellulose resin and/or the like.

The thickness of the primer layer can be, but not limited to, for example, 0.2 μm or more and 2 μm or less.

The primer layer can be formed in such a way that the above-mentioned materials are dispersed or dissolved in water or a suitable solvent, and the mixture is coated on the substrate by known means such as roll coating, reverse roll coating, gravure coating, reverse gravure coating, bar coating and rod coating to form a coating film, and the film is then dried.

EXAMPLES

The present invention will now be described by means of examples, but the present invention is not to be limited to these examples.

Example 1

The coating solutions for forming the release layer of the following composition was coated on one side of the adhesive-treated PET film having a thickness of 4.5 μm and dried to form a release layer having a thickness of 0.3 μm.

<Coating Solution for Forming the Release Layer>

| | |
|---|---|
| Polyethylene glycol (PEG)1 (manufactured by Sanyo Chemical Industries, Ltd., PEG10000, Mn 10000, Melting point 62° C.) | 10 parts by mass |
| Methyl ethyl ketone (MEK) | 50 parts by mass |
| Isopropanol (IPA) | 50 parts by mass |

On the release layer formed as described above, the coating solutions for forming the colorant layer of the following composition was coated and dried to form a colorant layer having a thickness of 0.7 μm.

<Coating Solution for Forming the Colorant Layer>

| | |
|---|---|
| First polyester A (manufactured by Toyobo Co., Ltd., VYLON (registered trade name) 200, Mn 17000) | 12.4 parts by mass |
| Second polyester A (manufactured by Toyobo Co., Ltd., VYLON (registered trade name) 220, Mn 3000) | 11 parts by mass |
| Carbon black | 16 parts by mass |
| Toluene | 100 parts by mass |
| MEK | 100 parts by mass |

On the colorant layer formed as described above, the coating solutions for forming the adhesive layer of the following composition was coated and dried to form an adhesive layer having a thickness of 0.2 μm.

<Coating Solution for Forming the Adhesive Layer>

| | |
|---|---|
| Polyester (manufactured by Toyobo Co., Ltd., VYLON (registered trade name) GK250, Mn 10000, Tg 60° C.) | 8 parts by mass |
| Chlorinated polypropylene (Nippon Paper Industries Co., Ltd., SUPERCHLON (registered trade name) 3221, Mn 50000, softening point 70° C.) | 2 parts by mass |
| Toluene | 72 parts by mass |
| MEK | 18 parts by mass |

The coating solutions for forming the back layer of the following composition was coated on the other side of the PET film was coated and dried to form a back layer having a thickness of 0.3 μm to obtain a thermal transfer sheet.

<Coating Solution for Forming the Back Layer>

| | |
|---|---|
| Styrene-acrylonitrile copolymer | 11 parts by mass |
| Linear saturated polyester | 0.3 parts by mass |
| Zinc stearyl phosphate | 6 parts by mass |
| Melamine resin powder | 3 parts by mass |
| MEK | 80 parts by mass |

Examples 2 to 18 and Comparative Examples 1 to 3

The thermal transfer sheets was produced in the same way as in Example 1 except that the compositions of release layers and colorant layers were changed as shown in Table 1.

Note that the detail of each component in Table 1 is as follows. In addition, in the table, the ratio of the content of the first polyester to the content of the second polyester (the content of the first polyester/the content of the second polyester) is referred to as "ratio of polyester content".

<Release Layer>

PEG2: manufactured by Sanyo Chemical Industries, Ltd., PEG20000, Mn 20000, Melting point 62° C.

PEG3: manufactured by Sanyo Chemical Industries, Ltd., PEG13000, Mn 13000, Melting point 62° C.

PEG4: manufactured by Sanyo Chemical Industries, Ltd., PEG6000, Mn 6000, Melting point 62° C.

Carnauba wax: Konishi Co., Ltd., WE-95, Melting point 82° C.

<Colorant Layer>

First polyester B: manufactured by Toyobo Co., Ltd., VYLON (registered trade name) 290, Mn 22000

Second polyester B: manufactured by Unitika Ltd., elitel (registered trade name) UE-3350, Mn 5000

Third polyester: manufactured by Toyobo Co., Ltd., VYLON (registered trade name) GK250, Mn 10000, Tg 60° C.

Vinyl chloride-vinyl acetate copolymer (VCA) A: manufactured by Nissin Chemical Industry Co., Ltd., SOLBIN (registered trade name) CNL, Mn 12000

Vinyl chloride-vinyl acetate copolymer (VCA) B: manufactured by Nissin Chemical Industry Co., Ltd., SOLBIN (registered trade name) CL, Mn 25000

(Meth)acryl resin: Mitsubishi Chemical Corporation, DIANAL (registered trade name) BR-87, Mn 25000

<<Evaluation-1 of Image-Forming Ability>>

Figure 3:
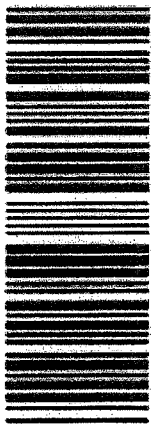
FIG. 3 is a diagram showing a Ladder bar code image formed in the Example.

The thermal transfer sheets obtained in the above Examples and Comparative examples and the label printer (manufactured by Zebra Co. Ltd., Zebra 140Xi4) were used to form Ladder bar code printings (The bar code was present perpendicularly to the direction of printing) as shown in FIG. 3 on polypropylene (PP) labels (manufactured by UPM Raflatac Co. Ltd., Polyprint PLUS Matt-coated synthetic PP film) which were transfer objects having a poor smoothness. Note that printing speed was set to be 6 IPS (inch per second), and printing energy was set to be 24.

The images formed were checked by visual observation and also judged by bar code checker (manufactured by Honeywell, Quick Check 850), and evaluated based on the evaluation criteria described below. The evaluation results are summarized in Table 1.

(Evaluation Criteria)

A: No void was observed on the image, and the judgment result by bar code checker was A or B.

B: A few voids were observed on the image, and the judgment result by bar code checker was C.

C: Some voids were observed on the image, and the judgment result by bar code checker was D, but which was to such an extent that was not practically problematic.

NG: A lot of voids were observed, and the judgment result by bar code checker was F or indeterminable, which was practically problematic.

<<Evaluation-2 of Image-Forming Ability»

The Ladder bar code images were formed in the same way as in the label printing evaluation except that the transfer objects were changed to PP labels (manufactured by UPM Raflatac Co. Ltd., PP SOLID White TC60 BOPP Top Coated solid film) that were transfer objects having a high smoothness.

The images formed were checked by visual observation and also judged by the above-mentioned bar code checker, and evaluated based on the evaluation criteria described below. The evaluation results are summarized in Table 1.

(Evaluation Criteria)

A: No image collapse was observed on the image, and the judgment result by bar code checker was A or B.

B: A few image collapses were observed on the image, and the judgment result by bar code checker was C.

C: Some image collapses were observed on the image, and the judgment result by bar code checker was D, but which was to such an extent that was not practically problematic.

NG: A lot of image collapses were observed, and the judgment result by bar code checker was F or indeterminable, which was practically problematic.

<<Alcohol Resistance Evaluation>>

Figure 4:
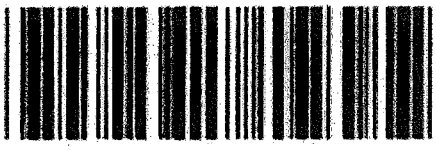
FIG. 4 is a diagram showing a picket bar code image formed in the Example.

The thermal transfer sheets obtained in the above Examples and Comparative examples and the above-mentioned label printer were used to form picket bar code images (The bar code was present parallel to the direction of printing) as shown in FIG. 4 on polyethylene terephthalate (PET) labels (manufactured by Avery Co. Ltd., 72825) which were transfer objects having a high smoothness. Note that printing speed was set to be 6 IPS, and printing energy was set to be 22. The images formed were judged by the bar code checker, and evaluated and the results were summarized in Table 1.

The image surfaces formed as described above were rubbed back and forth 10 times with cotton cloth soaked by 0.5 mL of isopropanol at the load of 200 g using a Colour Fastness Test Instrument (Model FR-2S, manufactured by Suga Test Instruments Co., Ltd., This is in conformity to JIS L 0849 (issued in 2013) under the environment of 22.5° C. and relative humidity of 40%. The images after rubbing were judged by the bar code checker and the results were summarized in Table 1, and also evaluated based on the evaluation criteria described below and the evaluation results are summarized in Table 1.

(Evaluation Results)

A: The judgement result by the bar code checker was not changed.

NG1: The judgement result by the bar code checker was deteriorated by one stage.

NG2: The judgement result by the bar code checker was deteriorated by two stages or more.

<<Image Density Evaluation>>

The thermal transfer sheets obtained in the above Examples and Comparative examples and the above-mentioned label printer were used to form solid images on polyethylene terephthalate (PET) labels (manufactured by Avery Co. Ltd., 72825) which were transfer objects having a high smoothness. Note that printing speed was set to be 6 IPS, and printing energy was set to be 22. The image density of the image formed was measured by the spectrophotometer (manufactured by Macbeth, RD918) and also evaluated based on the evaluation criteria described below. The evaluation results are summarized in Table 1.

(Evaluation Results)

A: The image density was 1.5 or more.

B: The image density was 1.3 or more and less than 1.5.

NG: The image density was less than 1.3.

<<Evaluation of Resistance to Rubbing>>

The picket bar code images were formed on the PET labels in the same way as in the alcohol resistance evaluation. The images formed were rubbed with a patch under the condition described below and the image states were visually observed to evaluate the resistance to rubbing of printed matters according to the evaluation criteria described below. The evaluation results are summarized in Table 1.

(Rubbing Condition)

Tester: Trade name: RUBBER METER, manufactured by Suga Test Instruments Co., Ltd.

Load: 800 (g)

Speed: 150 (mm/sec.)

Number of back-and-forth rubbing: 20 times

Patch: JIS Test fabric of JIS L 0803 for use testing fastness of color (KANAKIN No. 3 (Cotton))

(Evaluation Criteria)

A: No image omission was observed.

B: A few image omissions were observed.

C: a lot of image omissions were observed, but which was to such an extent that was not practically problematic.

D: Image omission(s) was/were remarkable and practically problematic.

<<Temporal Stability Evaluation>>

The coating solutions which were used to form the release layers included by the thermal transfer sheets in Examples and Comparative examples described above were allowed to stand for 7 days under the environment of temperature of 22.5° C. and relative humidity of 40%. The temporal stabilities of the coating solutions after standing were evaluated based on the evaluation criteria described below. The evaluation results are summarized in Table 1.

(Evaluation Criteria)

A: Even after standing for one week or more, it was re-dispersed only by light shaking.

B: it was re-dispersed only by light shaking after standing for one day, but thickening was observed after standing for one week.

C: Thickening was observed after standing for one day.

TABLE 1

| | Composition of release layer (% by mass) | | | | | Detail of colorant layer | | | |
|---|---|---|---|---|---|---|---|---|---|
| | | | | | | Composition of colorant layer (% by mass) | | | |
| | PEG1 (Mn 10000, Melting point62° C.) | PEG2 (Mn 20000, Melting point62° C.) | PEG3 (Mn 13000, Melting point62° C.) | PEG4 (Mn 6000, Melting point62° C.) | Carnauba wax | First polyester A (Mn 17000) | First polyester B (Mn 22000) | Second polyester A (Mn 3000) | Second polyester B (Mn 5000) |
| Example 1 | 100 | | | | | 31 | | 28 | |
| Example 2 | | | 100 | | | 31 | | 28 | |
| Example 3 | 100 | | | | | 32 | | 38 | |
| Example 4 | 100 | | | | | 27 | | 32 | |
| Example 5 | 100 | | | | | 35 | | 24 | |
| Example 6 | 100 | | | | | 30 | | 40 | |
| Example 7 | | 100 | | | | 31 | | 28 | |
| Example 8 | 100 | | | | | | 31 | 28 | |
| Example 9 | 100 | | | | | 31 | | | 28 |
| Example 10 | 50 | | | | 50 | 31 | | 28 | |
| Example 11 | 100 | | | | | | | | |
| Example 12 | 50 | | | | 50 | | | | |
| Example 13 | 100 | | | | | | | | |
| Example 14 | 100 | | | | | | | | |
| Example 15 | 100 | | | | | | | | |
| Example 16 | 100 | | | | | 31 | | 14 | |
| Example 17 | 100 | | | | | | | | |
| Example 18 | 100 | | | | | 37 | | 43 | |
| Comparative Example 1 | | | | 100 | | 31 | | 28 | |
| Comparative Example 2 | | | | | 100 | 31 | | 14 | |
| Comparative Example 3 | 100 | | | | | | | | |

| | Detail of colorant layer | | | | | | | Performance evaluation |
|---|---|---|---|---|---|---|---|---|
| | Composition of colorant layer (% by mass) | | | | | | | |
| | Third polyester (Mn 10000) | VGA A (Mn 12000) | VCA B (Mn 25000) | (Meth)acryl resin (Mn25000) | Carbon black | Content of resin material (% by mass) | Ratio of polyester contents | Image-forming ability-1 |
| Example 1 | | | | | 41 | 59 | 53/47 | A |
| Example 2 | | | | | 41 | 59 | 53/47 | A |
| Example 3 | | | | | 30 | 70 | 46/54 | A |
| Example 4 | | | | | 41 | 59 | 46/54 | A |
| Example 5 | | | | | 41 | 59 | 60/40 | A |
| Example 6 | | | | | 30 | 70 | 56/44 | A |
| Example 7 | | | | | 41 | 59 | 53/47 | B |
| Example 8 | | | | | 41 | 59 | 53/47 | A |
| Example 9 | | | | | 41 | 59 | 53/47 | A |
| Example 10 | | | | | 41 | 59 | 53/47 | A |
| Example 11 | | 56 | | | 44 | 56 | — | A |
| Example 12 | | 56 | | | 44 | 56 | — | A |
| Example 13 | | 70 | | | 30 | 70 | — | A |
| Example 14 | | 45 | | | 55 | 45 | — | A |
| Example 15 | | | 56 | | 44 | 56 | — | A |
| Example 16 | | | | | 55 | 45 | 68/32 | A |
| Example 17 | 59 | | | | 41 | 59 | — | A |
| Example 18 | | | | | 20 | 80 | 46/54 | A |

TABLE 1-continued

| | | | | | | |
|---|---|---|---|---|---|---|
| Comparative Example 1 | | 41 | 59 | 53/47 | A |
| Comparative Example 2 | | 55 | 45 | 68/32 | NG |
| Comparative Example 3 | 56 | 44 | 56 | — | NG |

| | Performance evaluation | | | | | | |
|---|---|---|---|---|---|---|---|
| | | Alcohol resistance | | | | | |
| | Image-forming ability-2 | Bar code checker judgement before rubbing | Bar code checker judgement after rubbing | Evaluation | Image density | Resistance to rubbing | Temporal stability |
| Example 1 | A | A | A | A | A | B | B |
| Example 2 | A | A | A | A | A | B | B |
| Example 3 | A | A | A | A | B | B | B |
| Example 4 | A | A | A | A | A | B | B |
| Example 5 | B | A | A | A | A | B | B |
| Example 6 | B | A | A | A | B | B | B |
| Example 7 | B | A | A | A | A | B | A |
| Example 8 | A | A | A | A | A | B | B |
| Example 9 | A | A | A | A | A | B | B |
| Example 10 | A | A | A | A | A | A | A |
| Example 11 | A | A | A | A | A | B | B |
| Example 12 | A | A | A | A | A | A | A |
| Example 13 | A | A | A | A | B | B | B |
| Example 14 | A | A | Not readable | NG2 | A | B | B |
| Example 15 | C | A | A | A | A | B | B |
| Example 16 | A | A | Not readable | NG2 | A | B | B |
| Example 17 | C | A | A | A | A | B | B |
| Example 18 | B | A | A | A | NG | B | B |
| Comparative Example 1 | NG | A | A | A | A | B | C |
| Comparative Example 2 | A | A | A | A | A | A | A |
| Comparative Example 3 | B | A | Not readable | NG2 | A | B | B |

EXPLANATION OF NUMERALS

10: thermal transfer sheet, 11: substrate, 12: release layer, 13: colorant layer, 14: adhesive layer, 15: transfer layer, 16: back layer

The invention claimed is:

1. A thermal transfer sheet, comprising:

a substrate; and a transfer layer comprising a release layer, a colorant layer and an adhesive layer, wherein the release layer comprises a polyethylene glycol having a number average molecular weight (Mn) in a range of 8000 to 23000, and wherein the colorant layer comprises a colorant and a vinyl chloride-vinyl acetate copolymer, wherein the vinyl chloride-vinyl acetate copolymer has a Mn of 20000 or less.

2. The thermal transfer sheet according to claim 1, wherein the colorant layer further comprises a first polyester having a Mn of 15000 or more, and a second polyester having a Mn of 5000 or less.

3. The thermal transfer sheet according to claim 1, wherein a content of all resin materials in the colorant layer is in a range of 55% by mass to 85% by mass.

4. The thermal transfer sheet according to claim 2, wherein a content of the first polyester in the colorant layer is in a range of 20% by mass to 40% by mass.

5. The thermal transfer sheet according to claim 2, wherein a content of the second polyester in the colorant layer is in a range of 20% by mass to 45% by mass.

6. The thermal transfer sheet according to claim 2, wherein a ratio of a mass of the first polyester in the colorant layer to a mass of the second polyester in the colorant layer is in a range of 45/55 to 80/20.

7. The thermal transfer sheet according to claim 1, wherein a melting point of the polyethylene glycol is in a range of 55° C. to 65° C.

8. The thermal transfer sheet according to claim 1, wherein the adhesive layer comprises at least one of a polyester and a chlorinated polyolefin.

* * * * *